United States Patent [19]

Hanses

[11] 4,178,681

[45] Dec. 18, 1979

[54] KNIFE AND SUPPORT ELEMENT THEREFOR

[76] Inventor: Ulf Hanses, Borganäsvägen 20, 78100 Borlänge, Sweden

[21] Appl. No.: 902,027

[22] Filed: May 2, 1978

[30] Foreign Application Priority Data

Nov. 3, 1977 [SE] Sweden ..... 772240

[51] Int. Cl.[2] ..... B26B 29/02

[52] U.S. Cl. ..... 30/151; 224/232; 224/242

[58] Field of Search ..... 30/151, 162, 296 A; 224/5 R

[56] References Cited

U.S. PATENT DOCUMENTS 2,507,019 5/1950 Johnson ..... 30/151

2,859,516 11/1958 McQueary ..... 30/151

2,901,823 9/1959 Widen ..... 30/151

*Primary Examiner*—Jimmy C. Peters

*Attorney, Agent, or Firm*—Pollock, Vande Sande and Priddy

[57] ABSTRACT

A knife, comprising a handle and an attached blade, is provided with an aperture in the handle for receiving a protrusion from a support element adapted to be attached to the knife. The support element comprises a sheath having an outstanding resilient tongue carrying the protrusion at a position such that, when the knife is inserted into the sheath, the protrusion resiliently snaps into the aperture in the knife handle to prevent withdrawal of the knife from the sheath until the protrusion is manually pressed out of the aperture by the finger of the user.

5 Claims, 4 Drawing Figures

KNIFE AND SUPPORT ELEMENT THEREFOR

The present invention relates to a knife and an associated supporting element, by means of which the knife can be worn on an article of dress, for instance a waist belt.

The most usual way hitherto of preventing a knife from falling out of an associated supporting element is to provide said element with some kind of strap or band, which is fastened across the knife-handle. The knife is thereby supplied with a rapier-guard placed between the handle and the blade. By the strap or the band being placed above said rapier guard, the knife is prevented from gliding out of the supporting element, which may have the form of a sheath. By the word knife is meant here all kinds of portable knives, including poinards and bayonets.

Common to the known methods of locking a knife to the support element is that they are all clumsy and also unsafe. When using belts or bands, these can break, and the clasp for said belts or bands can come undone.

Through the present invention, the disadvantages in known fastening methods are eliminated and an esthetically attractive form of fastening for a knife in an associated supporting element is obtained as well.

Figure 1:
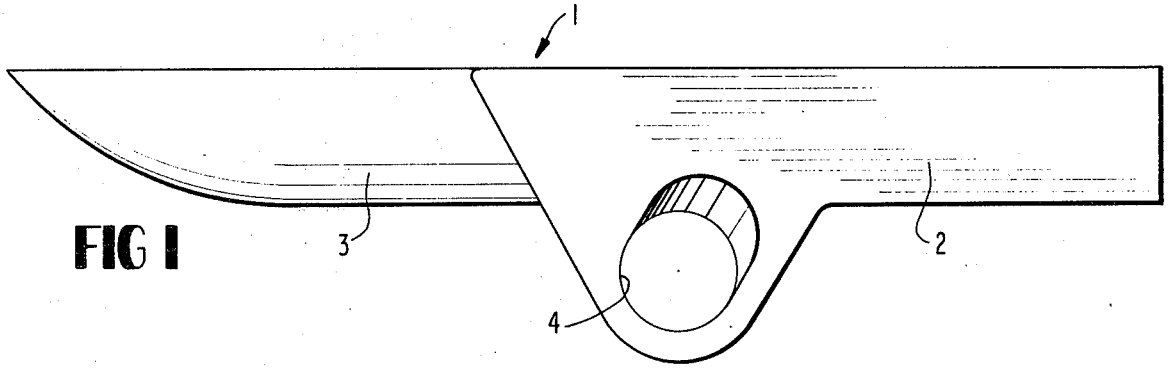
Figure 2:
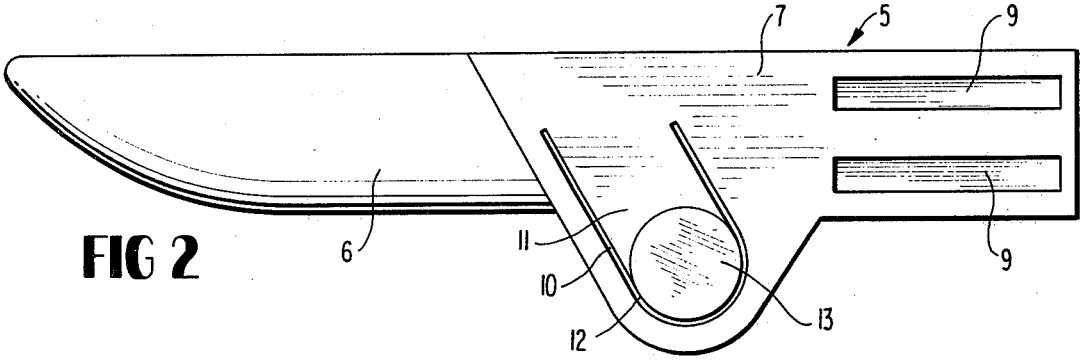
Figure 3:
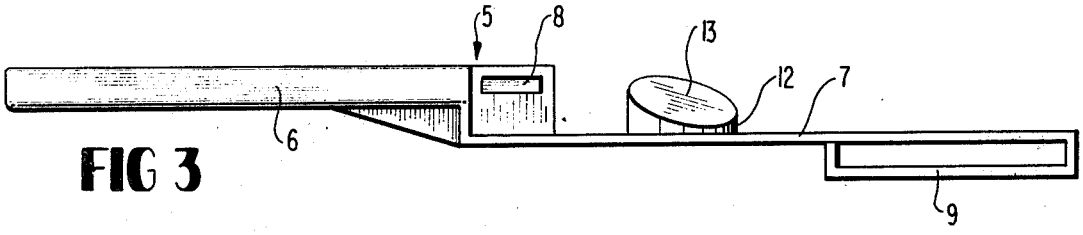
Figure 4:
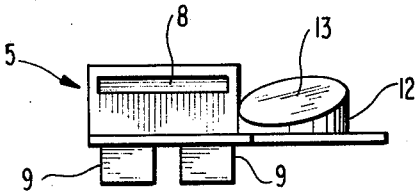

The invention will be more closely described in the form of an example with reference to the drawing, in which FIG. 1 in plan view shows the knife, FIG. 2 shows the supporting element in plan view, FIG. 3 shows the supporting element from the side, and FIG. 4 shows the supporting element from one end.

The knife 1 consists in a conventional manner of a handle 2 and a blade 3. The handle 2 which substantially is of uniform thickness, is at the end, which is turned to the blade 3, widened downwardly, i.e. in the direction of the blade edge, and provided with a hole 4, extending right through the handle 2. The hole 4 is at its upwardly turned edges bevelled and is intended for the index finger of the user to be pushed through. When the index finger of the user is bent around the handle 2, said finger should comfortably encircle the part in question of the handle.

The handle extends with one part forwardly towards the blade 3, which part on the upper side of the handle forms a surface which the thumb of the user effectively may grasp when for instance the knife is used for cutting.

The support element, which in the shown example has the form of a sheath 5, is provided with both a case 6 for enclosing the knife blade 3, and also with a part 7 underlaying the handle 2. The case 6 is thus hollow and has a lead-in slot 8 for the blade 3 as shown in FIGS. 3 and 4. The underlying part 7 is provided with recesses 9 stamped or cast in the sheath material which recesses with the rest of the underlying part form elongated ears, through which a waist belt or the like may be threaded.

The underlaying part 7 is, moreover, provided with an outstanding flange which defines a U-shaped slot 10 in the sheath material forming a flexible tongue 11. The free end of said tongue 11 supports an upwardly directed protrusion 12, which in shape is cylindrical. The diameter of the protrusion 12 is less than the diameter of the hole 4. The protrusion 12 is formed with its upper surface or free end 13 inclined in a direction which is downwards and outwards from the case 6, which is clearly apparent from FIGS. 2–4.

When the knife-blade 3 is inserted into the case 6, the enlargement of the handle 2 enclosing the hole 4 will, due to the inclination of the surface 13, press down the protrusion 12 positioned on the resilient tongue 11 and will glide over the same until the protrusion 12 snaps into hole 4. The protrusion 12 has such a height that the cylindrical envelope surface, forming the protrusion on the part turned towards the case 6, goes substantially complete through the hole 4 from one end of said hole.

When the protrusion 12 has snapped into the hole 4, the knife 1 is blocked in the sheath 5 and is prevented by co-operation between the protrusion 12 and hole 4 from gliding out of the sheath. In order to release the knife 1 from the sheath 5, the knife handle 2 is grasped suitably by the hand, and the protrusion 12 is pressed out of engagement with the hole 4 by the user's index finger, whereafter, the knife 1 can be pulled longitudinally out of the sheath 5.

It is within the scope of the invention to provide the protrusion directly on the underlying part 7 without a tongue, the whole sheath or the underlying part being given a certain torsional resilience, and/or the knife may be permitted, against the spring action, to rotate in the supporting part about its longitudinal axis.

I claim:

1. In a knife and sheath combination of the type wherein a knife is adapted to be inserted into and releasably latched in a sheath, the improvement wherein said knife comprises an elongated flat-sided handle of substantially uniform thickness having an elongated flat blade attached thereto, said handle being a substantially uniform width along a first portion of its length extending from the free end of said handle toward said blade, said first portion of said handle being substantially equal in width to the width of said knife blade, and said handle being widened outwardly along a second portion of its length to provide a flat-sided first flange which extends integrally from said handle beyond the cutting edge of said knife in a plane parallel to the plane of said blade at a location adjacent the junction of said handle and blade, said first flange having a cylindrical hole extending completely therethrough along an axis transverse to the plane of said knife blade and outwardly of said cutting edge, said hole being of sufficient diameter to permit the insertion of the finger of a user therein, said sheath comprising an elongated support member having a length substantially equal to that of said knife, said support member including a flat-sided sheath portion integral therewith for receiving said knife blade, said sheath portion extending from one end of said support member to an intermediate point on said support member and having a length substantially equal to the length of said knife blade, and said support member including a further flat-sided portion integral with said sheath portion and extending from said intermediate point on said support member to the other end of said support member, said further portion of said support member having a length substantially equal to the length of said knife handle, said further portion of said support member having a first section of substantially uniform width which is parallel to and underlies the uniform width portion of said flat-sided handle when said blade is fully inserted into said sheath portion, and a second section which is widened outwardly of said first section to provide an integral flat-sided second flange which is parallel to and underlies the said first flange of said knife handle when said blade is fully inserted into said sheath portion of said support member, at least part of said second flange being resiliently displaceable relative to said first flange, and a cylindrical protrusion integral with said second flange and extending upwardly therefrom toward said first flange of said knife handle along an axis which is substantially coincident with the axis of said cylindrical hole in said first flange when said blade is fully inserted into said sheath portion, said cylindrical protrusion having a diameter substantially equal to the diameter of said hole and having an upper surface which is inclined downwardly and outwardly relative to the said sheath portion of said support member whereby, when said knife blade is inserted into said sheath portion, said cylindrical protrusion on said second flange snaps into the cylindrical hole on said first flange from the lower end of said cylindrical hole to latch said knife to said support member, and said knife may be unlatched from said support member for removal from said sheath portion by insertion of the finger of a user into the upper end of said cylindrical hole to press against said inclined upper surface of said protrusion and to push said protrusion completely out of said hole by resilient displacement of said second flange on said support member relative to said first flange on said knife handle.

2. The combination of claim 1 wherein said first and second flanges are substantially congruent in shape.

3. The combination of claim 2 wherein the shapes of said first and second flanges are substantially triangular.

4. The combination of claim 1 wherein the edges of said cylindrical hole adjacent the said upper end of said hole are beveled to facilitate the insertion of the finger of a user therein.

5. The combination of claim 1 wherein said second flange includes a U-shaped slot therein defining a flexible tongue which is resiliently displaceable out of the plane of said second flange, said cylindrical protrusion being integral with and upstanding from said flexible tongue.

* * * * *